US011591865B1

(12) United States Patent
Wang et al.

(10) Patent No.: US 11,591,865 B1
(45) Date of Patent: Feb. 28, 2023

(54) METHOD, DEVICE AND SYSTEM OF VIBRATION REDUCTION CONTROL ON INSTALLATION OF DEEPWATER DRILLING RISER

(71) Applicant: China University of Petroleum—Beijing, Beijing (CN)

(72) Inventors: Yanbin Wang, Beijing (CN); Jinduo Wang, Beijing (CN); Deli Gao, Beijing (CN); Shilin Xin, Beijing (CN)

(73) Assignee: China University of Petroleum—Beijing, Beijing (CN)

( * ) Notice: Subject to any disclaimer, the term of this patent is extended or adjusted under 35 U.S.C. 154(b) by 0 days.

(21) Appl. No.: 17/871,870

(22) Filed: Jul. 22, 2022

(30) Foreign Application Priority Data

Jul. 22, 2021 (CN) ..... 202110832020.5

(51) Int. Cl.
*E21B 19/00* (2006.01)
*E21B 19/16* (2006.01)

(52) U.S. Cl.
CPC ..... *E21B 19/165* (2013.01); *E21B 19/002* (2013.01)

(58) Field of Classification Search
CPC ..... E21B 19/002
See application file for complete search history.

(56) References Cited

U.S. PATENT DOCUMENTS 7,080,689 B2 * 7/2006 Guesnon ..... E21B 47/001 702/6
7,328,741 B2 * 2/2008 Allen ..... E21B 19/004 702/152

(Continued)

FOREIGN PATENT DOCUMENTS

CN 105587308 A 5/2016
CN 107180129 A 9/2017

(Continued)

OTHER PUBLICATIONS

Zifeng Li, et al., Transverse Vibration Analysis of the Riser in Deepwater; Journal of Vibration, Measurement & Diagnosis, Dec. 2013, vol. 33, No. 6, pp. 1003-1007, China. (English abstract provided).

(Continued)

*Primary Examiner* — Matthew R Buck
(74) *Attorney, Agent, or Firm* — Pokalsky Wilczynski Brozek, LLP

(57) ABSTRACT

The present application provides a method, a device, and a system of vibration reduction control on the installation of a deepwater drilling riser. The method includes: determining a lateral vibration displacement of each position of the riser at different times in an installation process according to a mechanical model of the deepwater drilling riser in the installation process, determining a stress generated by a lateral vibration of the riser in the installation process, determining a vibration reduction control speed applied to a bottom of the riser in the installation process according to the stress and the lateral vibration displacement of each position of the riser at different times in the installation process, and performing a vibration reduction control on the bottom of the riser based on the vibration reduction control speed.

9 Claims, 6 Drawing Sheets

(56) References Cited

U.S. PATENT DOCUMENTS

| | | | | |
|---|---|---|---|---|
| 8,074,720 | B2 * | 12/2011 | Radi | G06K 7/00 702/6 |
| 8,439,109 | B2 * | 5/2013 | Sbordone | E21B 47/04 175/45 |
| 9,593,568 | B1 * | 3/2017 | LeMonds | E21B 47/007 |
| 2009/0056936 | A1 * | 3/2009 | McCoy, Jr. | E21B 43/013 166/250.01 |
| 2011/0214878 | A1 * | 9/2011 | Bailey | E21B 7/00 175/57 |
| 2014/0025319 | A1 * | 1/2014 | Farhadiroushan | E21B 47/007 702/56 |
| 2015/0176237 | A1 * | 6/2015 | Li | E02B 17/0017 703/2 |
| 2015/0346064 | A1 * | 12/2015 | Liu | E21B 17/01 702/188 |
| 2020/0165914 | A1 * | 5/2020 | Allara | E21B 47/07 |
| 2022/0356766 | A1 * | 11/2022 | Dziekonski | B63B 22/021 |

FOREIGN PATENT DOCUMENTS

| | | | |
|---|---|---|---|
| CN | 108319754 | A | 7/2018 |
| CN | 111577244 | A | 8/2020 |
| WO | 2017065961 | A1 | 4/2017 |

OTHER PUBLICATIONS

Qingyou Liu, et al., A Dynamic Model of Marine Risers/Pipes Under the Drilling Operation Condition and Sea Environment; Nature, Gas Ind, Dec. 2013, vol. 33, No. 12, pp. 6-12, China. (English abstract provided).

Weide Qiu, et al., Dynamic Analysis of Offshore Drilling Trap Pipes; Acta Oceanologia Sinica, Mar. 1988, vol. 10, No. 2, pp. 240-252, China. (English abstract provided).

Weide Qiu, et al., Nonlinear Time Domain Dynamic Analysis of Marine Drilling Riser; Journal of East China Petroleum Institute, Mar. 1987, vol. 11, No. 1, pp. 55-67, China. (English abstract provided).

Jindong Han, Research Progress on Deepwater Drilling Trap and Wellhead Technology; Drilling Division, China National Petroleum Group Offshore Engineering Co., Aug. 2018, pp. 181-182, China. (English abstract provided).

Pu Tu, et al., Study on Lateral Vibration Characteristics of Tensioner-Riser Coupling; China Petroleum Machinery, CNKI, Oct. 2020, pp. 78-84, China. (English abstract provided).

Jun Fang, et al., Test Method for the Force of Deformation of Deepwater Riser; China Petroleum Machinery, CNKI, Dec. 2013, pp. 53-57, China. (English abstract provided).

Shenyan Zhang, et al., Dynamic Charactristic Analysis on Deep-water Drilling Platform/Tensioner/Riser Coupling System; Journal of China University of Petroleum, Apr. 2019, vol. 43, No. 2, pp. 123-130, China. (English abstract provided).

Yanbin Wang, et al., Characteristic Analysis on Transverse Coupling Vibration of Offshore Drilling Riser-Drilling Fluid; Oil Drilling & Production Technolgy, CNKI, Jan. 2015, vol. 37, No. 1, pp. 25-29, China. (English abstract provided).

* cited by examiner

METHOD, DEVICE AND SYSTEM OF VIBRATION REDUCTION CONTROL ON INSTALLATION OF DEEPWATER DRILLING RISER

CROSS-REFERENCE TO RELATED APPLICATIONS

This application claims priority to Chinese Patent Application No. 202110832020.5, filed on Jul. 22, 2021, which is hereby incorporated by reference in its entirety.

TECHNICAL FIELD

The present application relates to the field of deepwater drilling engineering and, in particular, to a method, a device, and a system of vibration reduction control on the installation of a deepwater drilling riser.

BACKGROUND

With the deepening of human development and utilization on oil resources, the existing oil resources cannot meet human needs, so it is urgent to explore and find new oil resources. Deep oceans are valuable areas for oil development, and deep-water drilling technology plays a vital role in the exploitation of deep-sea oil resources. Deepwater drilling riser is a key equipment connecting a floating drilling platform and an underwater wellhead in deepwater drilling. Due to the poor marine environment, the riser will be subjected to the combined influence of waves and ocean currents in an installation process, resulting in a lateral vibration, which seriously affects the smooth running of the installation of the deepwater riser.

At present, there is no effective method for controlling the lateral vibration generated by the deepwater drilling riser in the prior art, which will seriously affect the connection between the riser and the underwater wellhead.

SUMMARY

The present application provides a method, a device, and a system of vibration reduction control on the installation of a deepwater drilling riser, which are used to solve the problem that a lateral vibration displacement of a riser in an installation process is large.

In a first aspect, the present application provides a method of vibration reduction control on the installation of a deepwater drilling riser, including:

determining a lateral vibration displacement of each position of the riser at different times in an installation process according to a mechanical model of the deepwater drilling riser in the installation process;

determining a stress generated by a lateral vibration of the riser in the installation process;

determining a vibration reduction control speed applied to a bottom of the riser in the installation process according to the stress and the lateral vibration displacement of each position of the riser at different times in the installation process; and performing a vibration reduction control on the bottom of the riser based on the vibration reduction control speed.

In a second aspect, the present application provides a device of vibration reduction control on the installation of a deepwater drilling riser, including:

a calculating module, configured to determine a lateral vibration displacement of each position of the riser at different times in an installation process according to a mechanical model of the deepwater drilling riser in the installation process, determine a stress generated by a lateral vibration of the riser in the installation process, and determine a vibration reduction control speed applied to a bottom of the riser in the installation process according to the stress and the lateral vibration displacement of each position of the riser at different times in the installation process; and a controlling module, configured to perform a vibration reduction control on the bottom of the riser based on the vibration reduction control speed.

In a third aspect, the present application provides a device of vibration reduction control on the installation of a deepwater drilling riser, including: a processor and a memory, the memory is stored with a code, and the processor runs the code stored in the memory to implement the method of vibration reduction control on the installation of a deepwater drilling riser according to the first aspect.

In a fourth aspect, the present application provides a system of vibration reduction control on the installation of a deepwater drilling riser, including: a remote operated vehicle connecting with a bottom assembly of the riser and a blowout preventer stack, the system further includes the device of vibration reduction control on the installation of a deepwater drilling riser according to the third aspect.

In a fifth aspect, the present application provides a computer-readable storage medium, and the computer-readable storage medium is stored with a computer execution instruction, and the computer execution instruction is configured to implement the method of vibration reduction control on the installation of a deepwater drilling riser according to any one of the first aspect when the computer execution instruction is executed by a processor.

The present application provides a method of vibration reduction control on the installation of a deepwater drilling riser. This method determines a mechanical model of the riser in an installation process based on stress conditions of the riser in the installation process, and further determines a lateral vibration displacement of each position of the riser at different times and a stress on the riser in the installation process, determines a vibration reduction control speed mode applied to a bottom of the riser in the installation process according to the stress and the lateral vibration displacement of each position of the riser at different times in the installation process, and determine a duration of vibration reduction control on the bottom of the riser based on the vibration reduction control speed mode. This reduces the lateral vibration displacement of the riser in the installation process, and achieves the effect of smooth connection between the riser and an underwater wellhead.

BRIEF DESCRIPTION OF DRAWINGS

The drawings herein are incorporated into the description and form a part of the description, which show the embodiments that are consistent with the present application, and are used to explain the principle of the present application together with the description.

Figure 1:
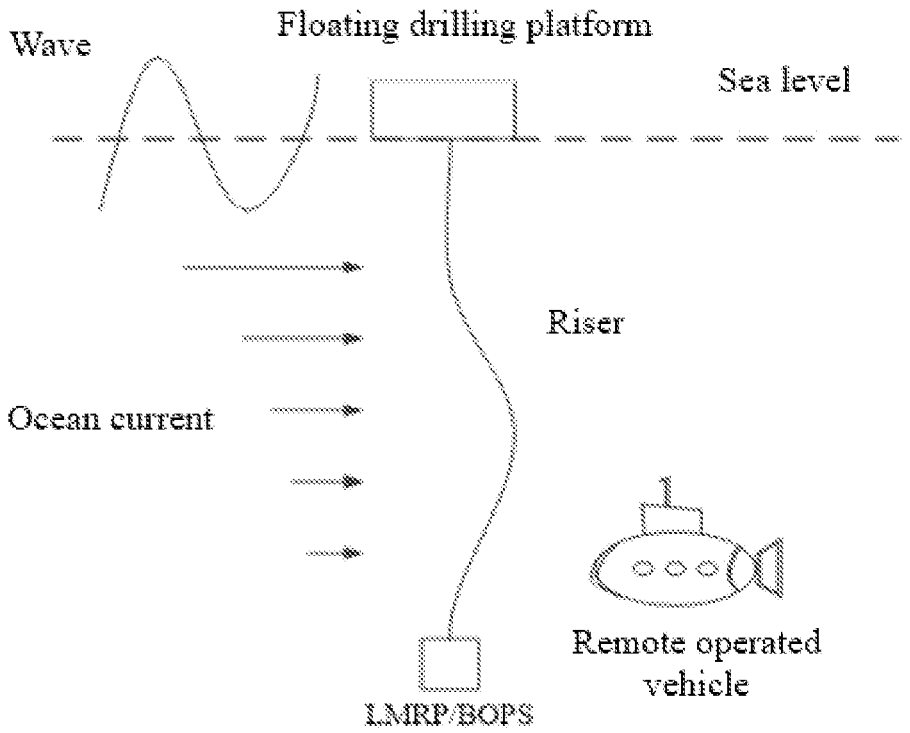
FIG. 1 is a scene diagram of controlling a lateral vibration of a deepwater drilling riser provided by an embodiment of the present application.

Through the above drawings, the specific embodiments of the present application have been shown, which will be described in more detail later. These drawings and descriptions are not intended to limit the scope of the concept of the present application in any way, but to explain the concept of the present application to those skilled in the art by referring to specific embodiments.

DESCRIPTION OF EMBODIMENTS

Exemplary embodiments will be described herein in detail, and examples thereof are shown in the drawings. When the following description refers to the drawings, unless otherwise indicated, the same number in different drawings represents the same or similar elements. The implementation modes described in the following exemplary embodiments do not represent all embodiments consistent with the present application. On the contrary, they are only examples of devices and methods that are describes in detail in the appended claims and are consistent with some aspects of the present application.

First, the terms involved in the present application are explained.

Riser: it is one of components of an underwater appliance, and it is a steel pipe connecting a subsea blowout preventer stack and a floating offshore drilling unit, and it is mainly used to separate seawater, introduce a drilling tool and a casing, and form a channel for mud circulation.

Blowout preventer: it is used to close a wellhead in a process of oil testing, workover, well completion, etc. to prevent an occurrence of a blowout accident. It integrates functions of full seal and half seal, has characteristics of simple structure, easy operation, high pressure resistance and so on, and is a safe sealing wellhead device commonly used in oil fields to prevent blowout.

Remote operated vehicle: namely, an underwater robot. For example, a typical remote operated vehicle system is composed of an on-water equipment part and an underwater equipment part. In which, the on-water part mainly includes a deck control unit, a cable winch, a release and recovery equipment, a power supply, and a navigation and data acquisition system, etc.; and the underwater equipment part is mainly composed of a submersible, an imaging system, an underwater acoustic positioning and tracking system, a mechanical arm, etc.

FIG. 1 is a scene diagram of controlling a lateral vibration of a deepwater drilling riser provided by an embodiment of the present application. As shown in FIG. 1, a riser will be subjected to actions of a wave and an ocean current in an installation process, resulting in a lateral vibration. In the present application, a vibration reduction control is applied in the installation of the deepwater drilling riser, specifically by controlling a remote operated vehicle (ROV) to apply a lateral dynamic displacement on a lower marine riser package/blowout preventer stack (LMRP/BOPS), so as to gradually reduce the horizontal spacing between the bottom of the riser and the underwater wellhead, thereby ensuring the smooth connection between the riser and the underwater wellhead.

The technical solution of the present application and how the technical solution of the present application solves the above technical problem are described in detail with specific embodiments. The following specific embodiments can be combined with each other, and the same or similar concepts or processes may not be repeated in some embodiments. The embodiments of the present application will be described below in combination with the drawings.

Figure 2:
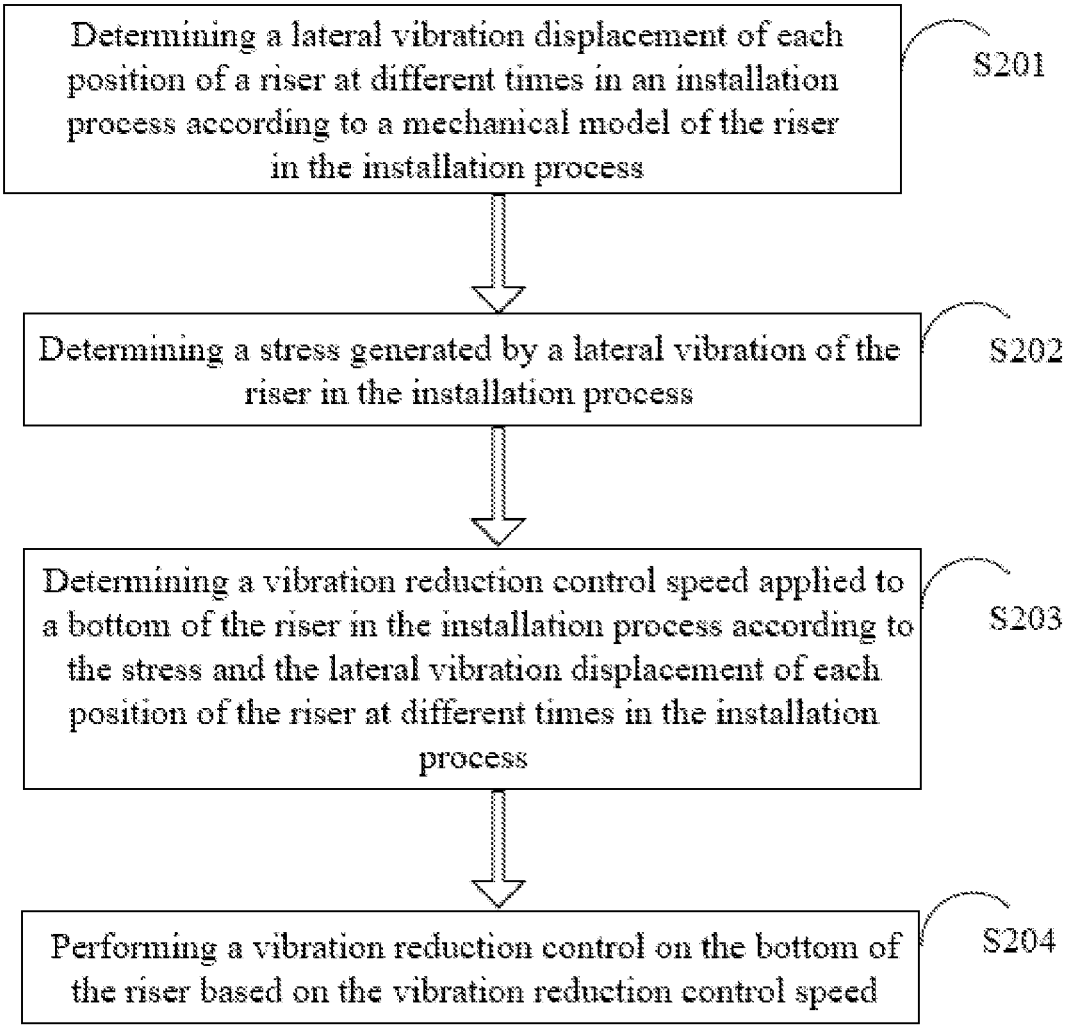
FIG. 2 is a flow chart of a method of vibration reduction control on the installation of a deepwater drilling riser provided by an embodiment of the present application.

FIG. 2 is a flow chart of a method of vibration reduction control on the installation of a deepwater drilling riser provided by an embodiment of the present application. As shown in FIG. 2, the method of the present embodiment may include:

S201: determining a lateral vibration displacement of each position of a riser at different times in an installation process according to a mechanical model of the riser in the installation process.

Where, the mechanical model is used to reflect stress conditions of the deepwater drilling riser in the installation process, including but not limited to, for example, the stress condition of the riser in a direction of water depth gradient, the stress condition in a direction of a wave force and an ocean current force, as well as the influence of inherent characteristics of the riser itself on the stress, such as a material property, a dependent variable and other factors.

Based on the above considerations, the mechanical model can be established in advance before the vibration reduction control is performed, to determine the lateral vibration displacement of each position of the riser at different times in the installation process. Each position may include: a top of the riser, a bottom of the riser, and several position points from top to bottom; different time points in the progress of the installation are shown according to different times in the process. Therefore, different positions and different time points form a many-to-many correspondence relationship, that is, each position on the riser at different time points may have different lateral vibration displacements; at each time point, different positions on the riser also have different lateral vibration displacements. Such correspondence relationship can be expressed in matrix form or in other forms.

S202: determining a stress generated by a lateral vibration of the riser in the installation process.

Where, a bending moment generated by the riser in the installation process is used as an intermediate value for calculating the stress to determine the magnitude of the stress on the riser over a certain length at a certain time.

In the present embodiment, after the lateral vibration displacement and the bending moment of the riser at a certain time are obtained, the stress can be further obtained. This method can be extended to the whole time period to solve lateral vibration reduction characteristics of the deepwater drilling riser over any length at any time in the installation process.

S203: determining a vibration reduction control speed applied to a bottom of the riser in the installation process according to the stress and the lateral vibration displacement of each position of the riser at different times in the installation process.

After the stress generated by the lateral vibration of the riser in the installation process and the lateral vibration displacement of each position of the riser at different times are determined, it is necessary to consider the influence of different speed control modes on the stress and lateral vibration displacement. The speed control mode can include a constant speed control, an acceleration control, a deceleration control, etc. The final speed control mode may be selected from the lateral vibration displacement generated by the riser and the magnitude of the stress on the riser. Stress factors considered may be the displacement when the bottom of the riser moves to be directly over the underwater wellhead, and the maximum value of the stress on the riser in a control process, thereby determining a vibration reduction control speed applied to the bottom of the riser in the installation process.

S204: performing a vibration reduction control on the bottom of the riser based on the vibration reduction control speed.

For the above mentioned constant speed control, acceleration control and deceleration control modes, maximum values of corresponding stresses may be determined respectively, where the deceleration control is that the maximum value of the stress is smallest. Therefore, the deceleration control may be selected for the vibration reduction control on the riser in the installation process, that is, the speed of applying a movement to the bottom decreases over time.

On this basis, the vibration reduction operation time is controlled, in which the factor to be considered is the magnitude of the stress on the riser, and then the vibration reduction operation time applied to the bottom of the riser is determined. When the vibration reduction control is applied to the deepwater drilling riser in the installation process, the vibration reduction control time may be increased on the premise of ensuring that the speed of the movement to the bottom gradually slows down, so as to ensure the applicability of this method of vibration reduction control.

The method of vibration reduction control on the installation of a deepwater drilling riser provided by an embodiment of the present application determines the lateral vibration displacement of each position of the riser at different times in the installation process according to the mechanical model of the deepwater drilling riser in the installation process, determines the stress generated by the lateral vibration of the riser in the installation process, and determine the vibration reduction control speed applied to the bottom of the riser in the installation process according to the stress and the lateral vibration displacement of each position of the riser at different times in the installation process, and perform a vibration reduction control on the bottom of the riser based on the vibration reduction control speed. The above method can effectively reduce the lateral vibration displacement generated by the riser in the installation process, realize the smooth connection between the riser and the underwater wellhead, and ensure the smooth progress of the installation operation.

The above steps of this embodiment further provide a specific implementation way of establishing a mechanical model of a riser in an installation process.

The mechanical model of the riser in the installation process is determined based on the stress on the top and bottom of the riser in the installation process and the lateral force to which the riser is subjected.

Due to the complexity of the stress on the deepwater drilling riser in the installation process and the diversity of affected factors, main influence factors can be considered, and secondary influence factors can be simplified. Therefore, it can be assumed that: (1) the riser is an ideal isotropic linearly-elastic material; (2) the strain of the riser is small and can be ignored; (3) geometric and mechanical properties of the riser in a direction of water depth gradient do not change; (4) a wave force and an ocean current force are in a same plane, and their propagation directions are consistent; (5) the ocean current force is a function of water depth and time.

It should be noted that a premise of the above modeling is that the embodiment is provided from a typical scene and in consideration of a simplified stress, but the present application is not limited thereto.

In an embodiment, the position where the top of the riser and the floating drilling platform are connected can be taken as the coordinate origin, the direction of water depth gradient is X axis, and the propagation direction of the force of the wave and the ocean current is Y axis;

$$EI\frac{\partial^4 y(x,t)}{\partial x^4} - T(x)\frac{\partial^2 y(x,t)}{\partial x^2} + m\frac{\partial^2 y(x,t)}{\partial t^2} = f(x,t)$$

where, E is an elastic modulus of the riser, Pa; I is a polar moment of inertia of the riser, $m^4$; T(x) is a tension at a top of the riser, N; y(x, t) is a lateral displacement of the riser, m; t is time, s; x is a length of the riser, m; m is a total mass of the riser per unit length, kg; f(x, t) is a combined force of the wave and the ocean current.

Because the top of the riser is connected with the floating drilling platform, the platform will generate a lateral periodic dynamic displacement under the wave action in the installation of the deepwater drilling riser. Therefore, a top boundary condition of the riser can be expressed as:

$$\begin{cases} y(0,t) = S(t) \\ EI\left.\frac{\partial^2 y}{\partial x^2}\right|_{x=0} = EI\frac{\partial^2 y(0,t)}{\partial x^2} = 0 \end{cases}$$

where, S(t) is a dynamic displacement of the floating drilling platform, m.

Where, because a displacement applied to the bottom of the riser by ROV is generated at the bottom, and a bottom boundary condition is:

$$\begin{cases} y(L,t) = Y(t) \\ EI\left.\frac{\partial^3 y}{\partial x^3}\right|_{x=L} = EI\frac{\partial^3 y(0,t)}{\partial x^3} = 0 \end{cases}$$

where, Y(t) is a lateral dynamic displacement applied by ROV, m; L is a water depth, m.

A periodic lateral movement of the drilling platform at the top can be expressed as:

$$S(t) = S_0 + S_L \cdot \sin\left(\frac{2\pi t}{T_L}\right)$$

where, $S_L$ is an amplitude value of slow drift of the platform, m; $T_L$ is a period of slow drift of the platform, s; $S_0$ is a static offset of the floating drilling platform, m; t is time, s.

A lateral force of the wave and the ocean current on the riser can be expressed as:

$$f(x,t) = \frac{\pi}{4}\rho_w C_M D^2 \frac{\partial v_w}{\partial t} + \frac{1}{2}\rho_w C_D D(v_w + v_c)|v_w + v_c|$$

where, $C_M$ is an additional mass coefficient, dimensionless; $C_D$ is a drag force coefficient, dimensionless; $\rho_w$ is a seawater density, kg/m$^3$; D is an outer diameter of the riser, m; $v_w$ is a horizontal velocity of wave particles, m/s; $v_c$ is a velocity of the ocean current, m/s.

When the lateral vibration displacement of each position at different times in the installation process is considered, the riser can be segmented in the length direction of the riser, and the operation time of the vibration reduction control can be divided into multiple operation time periods. Then, according to the mechanical model, the lateral vibration displacement of each segment of the riser in each operation time period in the installation process of the riser is determined.

Specifically, the riser can be divided into n segments in the x direction to get n+1 nodes. The length of each segment is set as h, and the nodes are numbered from top to bottom. The first node at the top is 1, and the last node at the bottom is n+1, i is used to represent any node. The time variate for ROV vibration reduction control operation is divided into m segments, and m+1 time nodes are obtained, the time scale of each segment is set as k, the time nodes are numbered, and j is used to represent any time node. Therefore, when the lateral vibration displacement of the riser is calculated, y (i,j) can be used to represent the displacement of the riser at the position of i and at the time of j, and f(i,j) represents an external load at the position of i and at the time of j;

where, the difference schemes for partial derivatives are obtained after expansion:

$$\left(\frac{\partial^2 y}{\partial t^2}\right)_i^j = \frac{y_i^{j+1} - 2y_i^j + y_i^{j-1}}{k^2} + o(k^2)$$

$$\left(\frac{\partial^2 y}{\partial x^2}\right)_i^j = \frac{y_{i+1}^j - 2y_i^j + y_{i-1}^j}{h^2} + o(h^2)$$

$$\left(\frac{\partial^3 y}{\partial x^3}\right)_i^j = \frac{y_{i+2}^j - 2y_{i+1}^j + 2y_{i-1}^j - y_{i-2}^j}{h^3} + o(h^3)$$

$$\left(\frac{\partial^4 y}{\partial x^4}\right)_i^j = \frac{y_{i+2}^j - 4y_{i+1}^j + 6y_i^j - 4y_{i-1}^j + y_{i-2}^j}{h^4} + o(h^4)$$

thus, a control equation can be converted into difference scheme:

$$EI\frac{y_{i+2}^j - 4y_{i+1}^j + 6y_i^j - 4y_{i-1}^j + y_{i-2}^j}{h^4} - T(i)\frac{y_{i+1}^j - 2y_i^j + y_{i-1}^j}{h^2} + m\frac{y_i^{j+1} - 2y_i^j + y_i^{j-1}}{k^2} = f(i, j)$$

Further, the control equation in the difference scheme is subjected to congeneric incorporation to obtain:

$$A_{i+2}{}^j + B_i y_{i+1}{}^j + C_i y_i{}^j + D_i y_{i-1}{}^j + E y_{i-2}{}^j = Ff(i,j)$$

where:

$$\begin{cases} A = k^2 EI \\ B_i = -4k^2 EI - k^2 h^2 T(i) \\ C_i = 6k^2 EI + 2k^2 h^2 T(i) - 2h^4 m \\ D_i = -4k^2 EI - k^2 h^2 T(i) \\ E = k^2 EI \\ F = k^2 h^4 \end{cases}$$

Where, the difference schemes for the boundary conditions are:

$$\begin{cases} y|_{x=0} = S(j) \\ EI\left.\frac{\partial^2 y}{\partial x^2}\right|_{x=0} = EI\frac{y_1^j - 2y_0^j + y_{-1}^j}{h^2} = 0 \end{cases}$$

$$\begin{cases} y|_{x=n+1} = Y(j) \\ EI\left.\frac{\partial^3 y}{\partial x^3}\right|_{x=n+1} = EI\frac{y_{n+3}^j - 2y_{n+2}^j + 2y_n^j - y_{n-1}^j}{h^3} = 0 \end{cases}$$

A shear force generated by the riser is taken as the bottom boundary condition, and the shear force generated by the riser can be expressed as:

$$Q_i^j = -\frac{EI(y_{i+2}^j + 2y_{i+1}^j - 2y_{i-1}^j + y_{i-2}^j)}{h^3}$$

where, $Q_i^j$ is the shear force of the riser at the length of i and at the time of j, N.

The lateral vibration displacement at the time of j is taken as an example, the distribution regularity of the lateral vibration displacement y(x,t) of the deepwater drilling riser in the installation in the direction of x is studied. By combining the control equation with the boundary conditions, an algebraic equation for calculating the lateral vibration reduction control on the deepwater drilling riser in the installation of the deepwater drilling riser at the time of j can be obtained:

$$\begin{bmatrix} 0 & 1 & 0 & 0 & 0 & \dots & 0 & 0 \\ 1 & -2 & 1 & 0 & 0 & \dots & 0 & 0 \\ E & D_1 & C_1 & B_1 & A & \dots & 0 & 0 \\ 0 & E & D_2 & C_2 & B_2 & \dots & 0 & 0 \\ \vdots & \vdots & \vdots & \vdots & \vdots & \ddots & \vdots & \vdots \\ 0 & 0 & 0 & 0 & 0 & \dots & 0 & 0 \\ 0 & 0 & 0 & 0 & 0 & \dots & 1 & 0 \\ 0 & 0 & 0 & 0 & 0 & \dots & -2 & 1 \end{bmatrix} \begin{bmatrix} y_{-1} \\ y_0 \\ y_1 \\ y_2 \\ \\ y_{n+1} \\ y_{n+2} \\ y_{n+3} \end{bmatrix} = \begin{bmatrix} S(j) \\ 0 \\ Fy(1, j) \\ Fy(2, j) \\ \vdots \\ Y(j) \\ 0 \\ 0 \end{bmatrix}$$

The equation group has n+5 equations, and n+5 lateral displacements to be solved, thus, this equation group can be solved in a closed manner to obtain the lateral vibration displacement generated by the riser in the installation process.

When the stress generated by lateral vibration of the riser in the installation process is determined, it can be determined according to the bending moment of each segment of the riser in each operation time period, as well as the cross-sectional area and anti-bending cross-sectional modulus of the riser.

The bending moment generated by the riser can be expressed as:

$$M_i^j = -\frac{EI(y_{i+1}^j + 2y_i^j - y_{i-1}^j)}{h^2}$$

where, $M_i^j$ is the bending moment of the riser at the length of i and at the time of j.

The stress on each segment of the riser in each operation time period is determined according to the bending moment, the cross-sectional area and anti-bending cross-sectional modulus of the riser.

The stress on the riser can be expressed as:

$$\sigma_i^j = \frac{T(i)}{s} \pm \frac{M_i^j}{W}$$

where, $\sigma_i^j$ is the stress on the riser at the length of i and at the time of j, MPa; S is the cross-sectional area of the riser, $mm^2$; W is the anti-bending cross-sectional modulus of the riser, $mm^3$.

After the stress is obtained, the vibration reduction control speed applied to the bottom of the riser in the installation process can be determined according to the stress and the lateral vibration displacement of each position of the riser at different times in the installation process.

In an embodiment, the maximum value of the stress and lateral vibration displacement value under a variety of different speed control modes are determined, the variety of different speed control modes include at least one of the following: a constant speed control, an acceleration control, and a deceleration control.

Under the variety of speed control modes, the control mode in which the maximum value of the lateral vibration displacement is smallest and the maximum value of the stress is smallest can be selected.

Where, the relevant information of a certain sea area and specific parameters of a riser are shown in the table:

| Calculation parameter | Value |
|---|---|
| Elastic modulus | $2.1 \times 10^{11}$ Pa |
| Outer diameter of riser | 0.5334 m |
| Inner diameter of riser | 0.5017 m |
| Density of riser | 7850 kg/m$^3$ |
| LMRP/BOPS Mass | 200 t |
| Depth of seawater | 1000 m |
| Inertia force coefficient | 2 |
| Wave period | 13 s |
| Wave height | 8 m |
| Sea surface wind speed | 1 m/s |
| Sea surface tidal velocity | 1 m/s |
| Density of seawater | 1030 kg/m$^3$ |
| Drag coefficient | 1.2 |
| Platform static offset | 2% of water depth |

Figure 3:
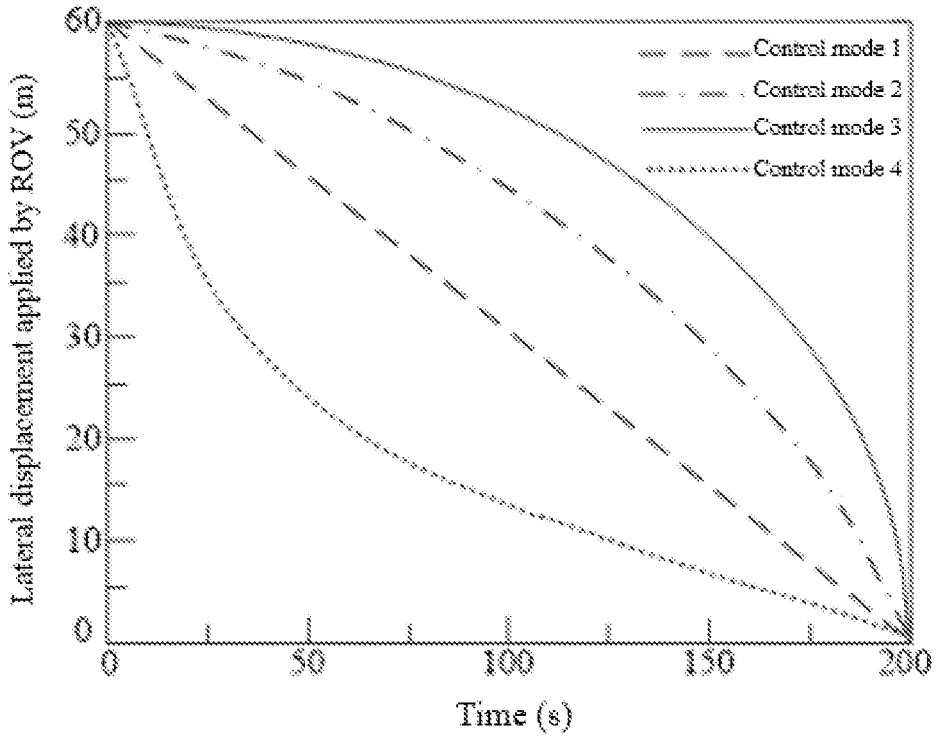
FIG. 3 shows four different vibration reduction control modes provided by an embodiment of the present application.

In this embodiment, FIG. 3 shows four different vibration reduction control modes. As shown in FIG. 3, the difference between the four control modes lies in the different speed of lateral displacement applied to the bottom by ROV. The speed for control mode 1 is constant, the speeds for control modes 2 and 3 are gradually accelerated, and the speed for control mode 4 is gradually reduced.

The expressions of the four vibration reduction control modes are as follows:

$$Y(t)=-0.3t+60 \quad \text{Control mode 1:}$$

$$Y(t)=-0.0015t^2+60 \quad \text{Control mode 2:}$$

$$Y(t) = 60\sqrt{1 - \frac{t^2}{40000}} \quad \text{Control mode 3}$$

$$Y(t) = -\log_{\sqrt[60]{200}} t + 60 \quad \text{Control mode 4}$$

where, if the riser is not subjected to a lateral vibration reduction treatment, the lateral vibration displacement generated is about 60 m.

Figure 4:
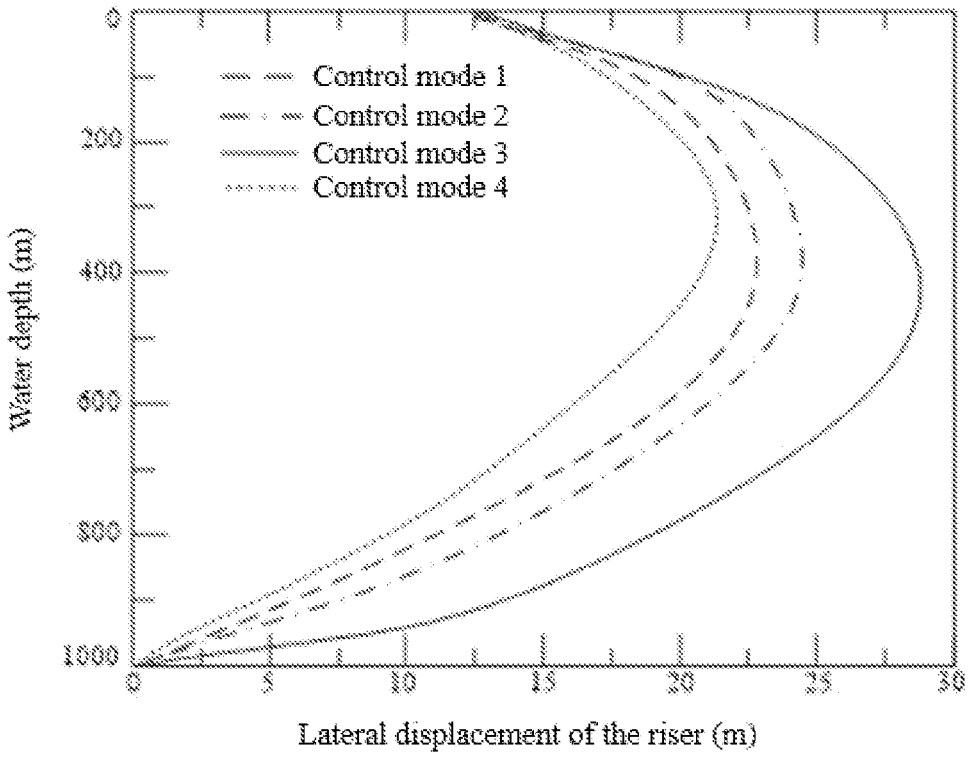
FIG. 4 is an overall displacement distribution of a riser provided by an embodiment of the present application.

In this embodiment, FIG. 4 shows an overall displacement distribution of a riser, and as shown in FIG. 4, after the riser is subjected to the vibration reduction controls, the displacement thereof is reduced to 23.5 m, 24.3 m, 27.7 m, and 22.6 m, respectively.

Figure 5:
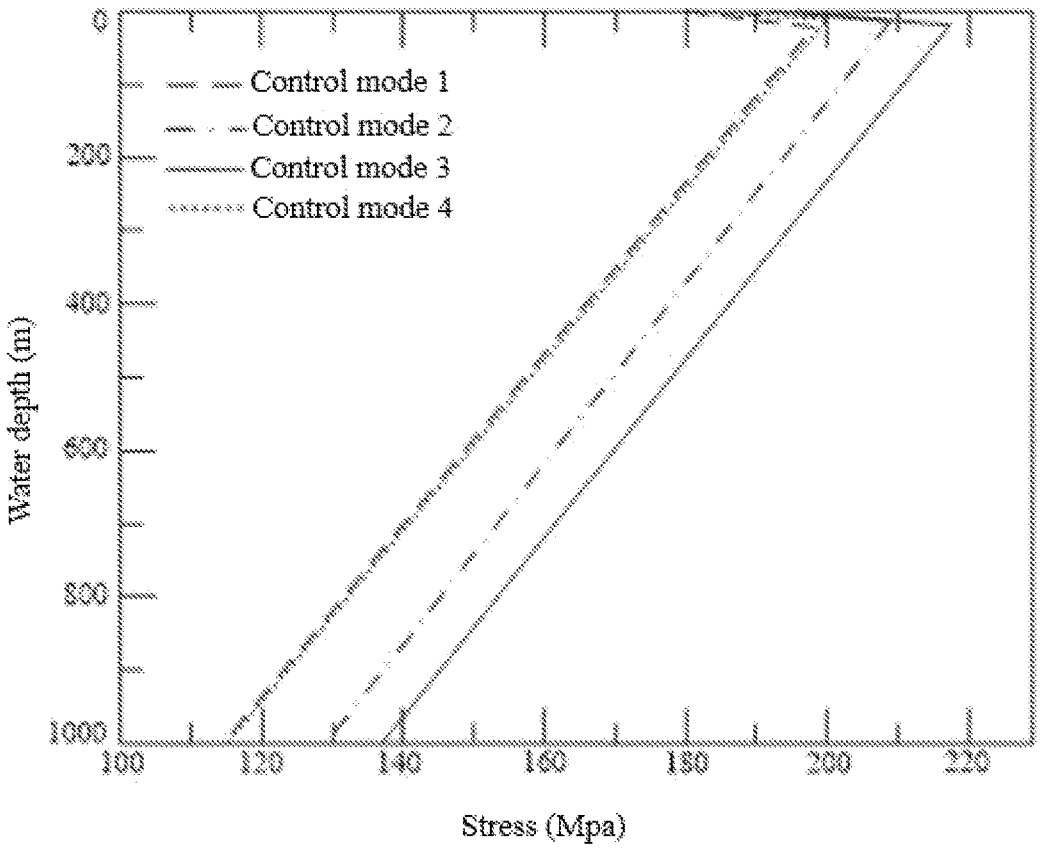
FIG. 5 shows a von Mises stress distribution of a riser provided by an embodiment of the present application.

In this example, FIG. 5 shows a von Mises stress distribution on a riser. Due to that a dynamic displacement is applied to the bottom of the riser, the bending moment and the stress to which the riser is subjected increase. As shown in FIG. 5, the stress on the riser under four different control modes increases to 198.2 MPa, 208.9 MPa, 216.4 MPa, and 197.9 MPa, respectively.

Furthermore, after the control mode 4 is applied, the overall displacement and the stress of the riser are significantly lower than that of the other three control modes. Therefore, the control mode 4 is the optimal form of lateral vibration reduction control on the deepwater drilling riser in the installation process, that is, the speed of displacement applied to the bottom gradually decreases.

After the speed control mode is determined, the bottom of the riser can be subjected to vibration reduction control based on a corresponding vibration control speed.

In consideration of the influence of the time duration of different vibration controls on the maximum value of the stress on the riser, the time duration of vibration control on the bottom of the riser can be further determined.

Figure 6:
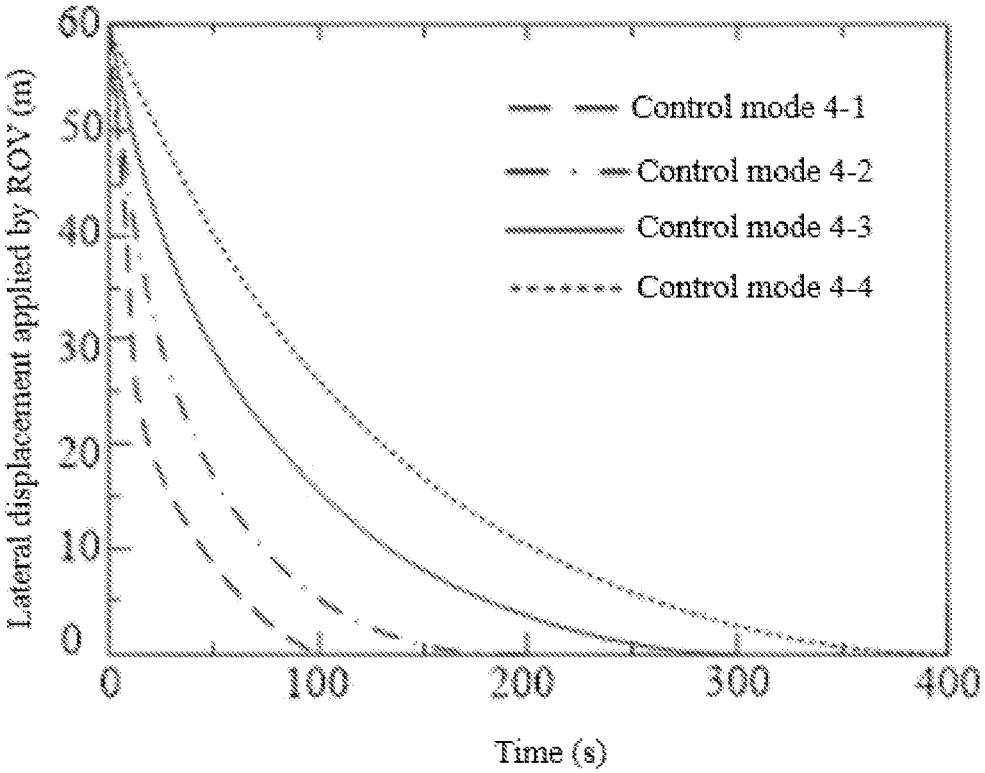
FIG. 6 shows four different control modes of vibration reduction operation time provided by an embodiment of the present application.

In this embodiment, FIG. 6 shows four different control modes of vibration reduction operation time, and the vibration reduction control operation time is selected as 100 s, 200 s, 300 s and 400 s, respectively. As shown in FIG. 6, the variation relationship between the lateral displacement applied by ROV and time under the four vibration reduction control modes is characterized. The displacement expressions of the four vibration reduction control modes are:

$$Y(t) = -\log_{\sqrt[60]{100}} t + 60 \quad \text{Control mode 4–1}$$

$$Y(t) = -\log_{\sqrt[60]{200}} t + 60 \quad \text{Control mode 4–2}$$

$$Y(t) = -\log_{\sqrt[60]{300}} t + 60 \quad \text{Control mode 4–3}$$

$$Y(t) = -\log_{\sqrt[60]{400}} t + 60 \quad \text{Control mode 4–4}$$

Figure 7:
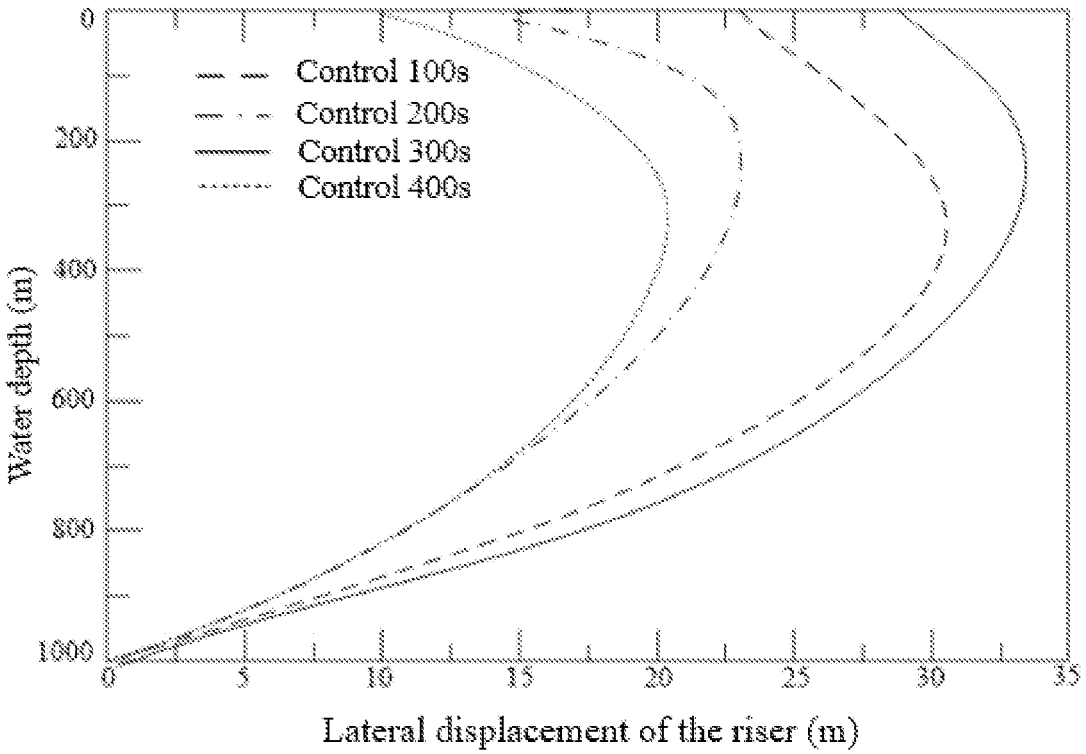
FIG. 7 shows an influence of an operation time on a lateral vibration displacement of a riser provided by an embodiment of the present application.

In this embodiment, FIG. 7 shows an influence of an operation time on a lateral vibration displacement of a riser. As shown in FIG. 7, with the vibration reduction control time increasing from 100 s to 400 s, when the bottom of the riser moves to the top of the underwater wellhead, the maximum value of the lateral vibration displacement of the riser is 30.5 m, 22.5 m, 32.5 m, and 20.5 m, respectively.

Figure 8:
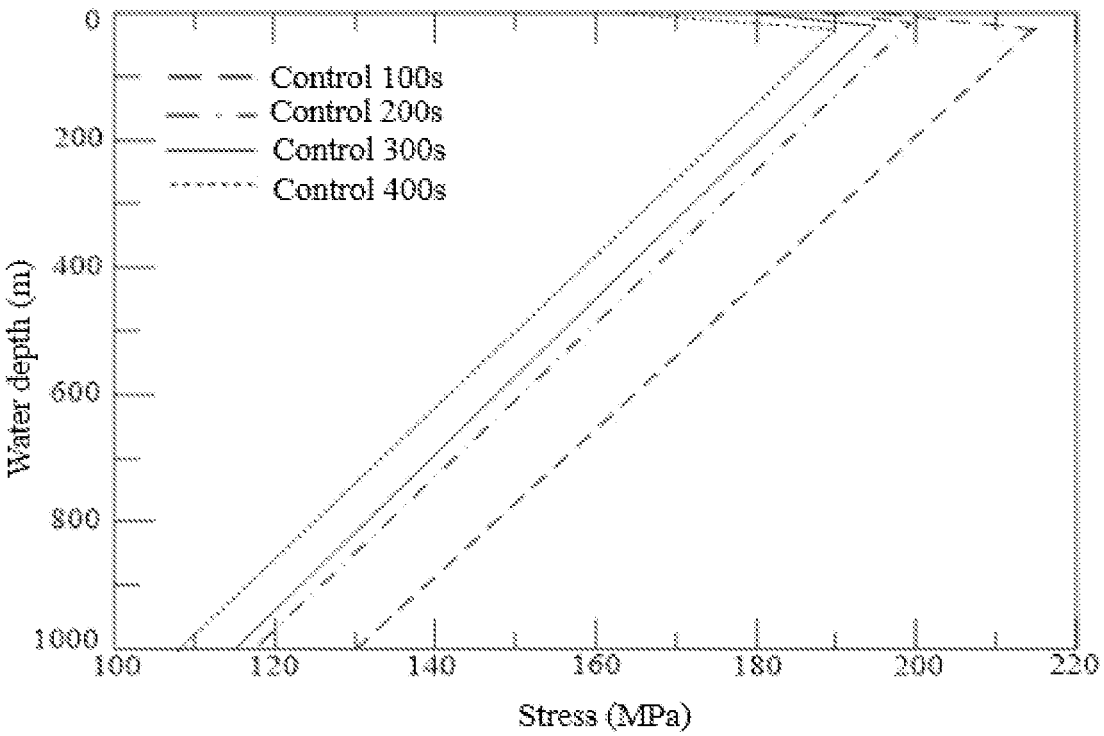
FIG. 8 shows an influence of an operation time on a von Mises stress of a riser provided by an embodiment of the present application.

In this embodiment, FIG. 8 shows an influence of an operation time on a von Mises stress to which a riser is subjected. As shown in FIG. 8, in the process of vibration reduction control, with the vibration reduction control time increasing from 100 s to 400 s, the maximum value of the stress on the riser decreases from 212.0 MPa to 187.5 MPa.

Furthermore, the operation time of the vibration reduction control has no regular influence on the lateral vibration displacement of the deepwater drilling riser after the riser is subjected to the vibration reduction, however, if the vibration reduction control time increases, the stress on the riser will reduce.

According to the stress and the lateral vibration displacement of each position of the riser at different times in the installation process, the embodiment of the present application can determine the vibration reduction control speed applied by the remote operated vehicle to the bottom of the riser in the installation process. Under various speed control modes such as a constant speed control, an acceleration control and a deceleration control, the control mode in which the maximum value of the lateral vibration displacement is smallest and the maximum value of the stress is smallest is selected. At the same time, the duration of the vibration control on the bottom of the riser is determined according to the influence of different vibration reduction control time durations on the maximum value of the stress of the riser.

Figure 9:
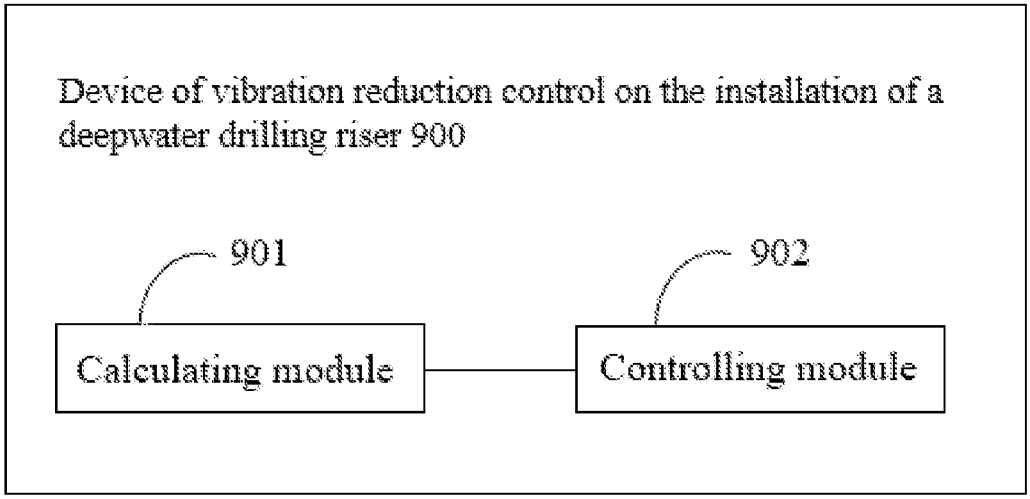
FIG. 9 is a schematic diagram of a device of vibration reduction control on the installation of a deepwater drilling riser provided by an embodiment of the present application.

FIG. 9 is a schematic diagram of a device of vibration reduction control on the installation of a deepwater drilling riser provided by an embodiment of the present application. As shown in the FIG. 9, the device of vibration reduction control on the installation of a deepwater drilling riser 900 provided by the present embodiment can include a calculating module 901 and a controlling module 902.

In an embodiment, the calculating module 901 is specifically configured to determine a lateral vibration displacement of each position of a deepwater drilling riser at different times in an installation process of the riser according to a mechanical model of the riser in the installation process; determine a stress generated by a lateral vibration of the riser in the installation process, and determine a vibration reduction control speed applied to a bottom of the riser in the installation process according to the stress and the lateral vibration displacement of each position of the riser at different times in the installation process.

In an embodiment, the controlling module 902 is specifically configured to perform a vibration reduction control on a bottom of the riser based on a vibration reduction control speed.

The device of the present embodiment can be used to implement the method embodiment shown in FIG. 2, and implementation principles and technical effects thereof are similar, which will not be repeated here.

Figure 10:
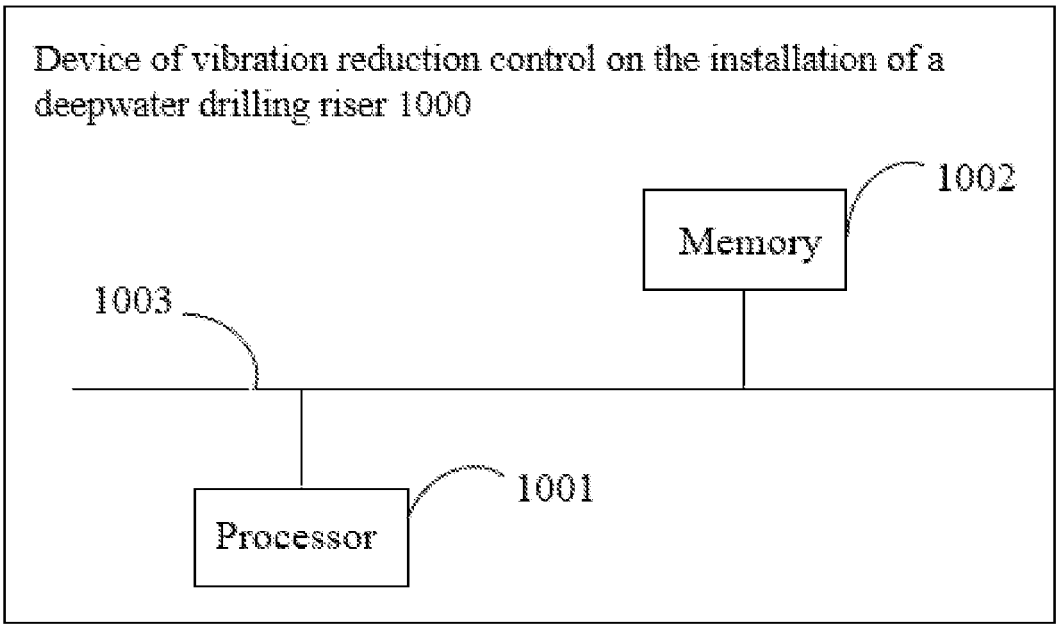
FIG. 10 is a schematic diagram of a device of vibration reduction control on the installation of a deepwater drilling riser provided by an embodiment of the present application.

FIG. 10 is a schematic diagram of a device of vibration reduction control on the installation of a deepwater drilling riser provided by an embodiment of the present application. As shown in FIG. 10, the embodiment of the present application provides a device of vibration reduction control on the installation of a deepwater drilling riser 1000, including a processor 1001 and a memory 1002, and the processor 1001 and the memory 1002 are connected through a bus 1003.

In a specific implementation process, the memory is stored with a code, and the processor runs the code stored in the memory to implement the method of vibration reduction control on the installation of a deepwater drilling riser of the above method embodiment.

The specific implementation process of processor 1001 can refer to the above method embodiment, and implementation principles and technical effects thereof are similar, which will not be repeated in the present embodiment.

In the above embodiment shown in FIG. 10, it should be understood that the processor may be a central processing unit (CPU), other general-purpose processors, a digital signal processor (DSP), an application specific integrated circuit (ASIC), etc. The general-purpose processor may be a microprocessor or the processor may also be any conventional processor, etc. The steps of the method that are in combination with the disclosure of the present application can be directly embodied as being executed by a hardware processor to complete, or by a combination of hardware and software modules in a processor.

The memory may include a high-speed RAM memory, and may also include a nonvolatile memory NVM, such as at least one disk memory.

The bus can be an industry standard architecture (ISA) bus, a peripheral component (PCI) bus or an extended industry standard architecture (EISA) bus, etc. The bus can be divided into an address bus, a data bus, a control bus, etc. For ease of representation, the bus in the drawings of the present application is not limited to only one bus or one type of bus.

The embodiment of the present application provides a system of vibration reduction control on the installation of a deepwater drilling riser. The system structure may refer to FIG. 1. The system may include: a remote operated vehicle connecting with a bottom assembly of the riser and a blowout preventer stack, the system further includes the device of vibration reduction control on the installation of a deepwater drilling riser in the above device embodiment.

The embodiment of the present application provides a computer-readable storage medium, the computer-readable storage medium is stored with a computer execution instruction. The computer execution instruction is configured to implement the method of vibration reduction control on the installation of a deepwater drilling riser in the above method embodiment when the computer execution instruction is executed by the processor.

The above computer-readable storage medium can be realized by any type of a volatile or nonvolatile storage device or their combination, such as a static random access memory (SRAM), an electrically erasable programmable read only memory (EEPROM), an erasable programmable read only memory (EPROM), a programmable read only memory (PROM), a read only memory (ROM), a magnetic memory, a flash memory, a magnetic disk or an optical disk. The readable storage medium can be any available medium that can be accessed by a general-purpose or special-purpose computer.

An exemplary readable storage medium is coupled to a processor so that the processor can read information from and write information to the readable storage medium. Of course, the readable storage medium can also be an integral part of the processor. The processor and the readable storage medium can be located in an application specific integrated circuit (ASIC). Of course, the processor and readable storage media can also exist in a device as discrete components.

Those skilled in the art can understand that all or part of the steps to implement the above method embodiments can be completed by hardware related to a program instruction. The aforementioned program can be stored in a computer readable storage medium. When the program is executed, the steps including the above method embodiments are executed; the aforementioned storage media includes ROM, RAM, magnetic disc or optical disc and other media that can store a program code.

After considering the specification and practicing the present application disclosed herein, those skilled in the art are easy to think of other embodiments of the present application. The present application aims to cover any variations, uses or adaptive changes of the present application, which follow general principles of the present application and include the common general knowledge or conventional technical means in the art that are not disclosed in the present application. The description and the embodiments are only regarded as exemplary.

It should be understood that the present application is not limited to the precise structure described above and shown in the drawings, and various modifications and changes may be made without departing from its scope.

What is claimed is:

1. A method of vibration reduction control on the installation of a deepwater drilling riser, comprising:

determining a lateral vibration displacement of each position of the riser at different times in an installation process according to a mechanical model of the deepwater drilling riser in the installation process;

determining a stress generated by a lateral vibration of the riser in the installation process;

determining a vibration reduction control speed applied to a bottom of the riser in the installation process according to the stress and the lateral vibration displacement of each position of the riser at different times in the installation process; and performing a vibration reduction control on the bottom of the riser based on the vibration reduction control speed.

2. The method according to claim 1, wherein before the determining the lateral vibration displacement of each position of the riser at different times in the installation process according to the mechanical model of the deepwater drilling riser in the installation process, further comprising:

determining the mechanical model of the riser in the installation process based on stress conditions of a top and the bottom of the riser in the installation process, and a lateral force to which the riser is subjected.

3. The method according to claim 1, wherein the determining the lateral vibration displacement of each position of the riser at different times in the installation process according to the mechanical model of the deepwater drilling riser in the installation process comprises:

segmenting the riser in a length direction of the riser, and dividing an operation time of the vibration reduction control into a plurality of operation time periods;

determining a lateral vibration displacement of each segment of the riser at each operation time period in the installation process according to the mechanical model.

4. The method according to claim 3, wherein the determining the stress generated by the lateral vibration of the riser in the installation process comprises:

determining a bending moment of each segment of the riser at each operation time period;

determining a stress of each segment of the riser at each operation time period according to the bending moment, a cross-sectional area and an anti-bending cross-sectional module of the riser.

5. The method according to claim 1, wherein the determining the vibration reduction control speed applied to the bottom of the riser in the installation process according to the stress and the lateral vibration displacement of each position of the riser at different times in the installation process comprises:

determining a maximum value of the stress and a lateral vibration displacement value under a variety of different speed control modes, wherein the variety of different speed control modes comprise at least one of the following: a constant speed control, an acceleration control, and a deceleration control;

selecting a control mode in which the maximum value of the lateral vibration displacement is smallest and the maximum value of the stress is smallest under the variety of speed control modes.

6. The method according to claim 1, wherein the performing the vibration reduction control on the bottom of the riser based on the vibration reduction control speed comprises:

determining a duration of the vibration reduction control on the bottom of the riser according to an influence of different durations of the vibration reduction control on a maximum value of the stress on the riser.

7. A device of vibration reduction control on the installation of a deepwater drilling riser, comprising: a processor and a memory, the memory is stored with a code, and the processor runs the code stored in the memory to implement the method of vibration reduction control on the installation of a deepwater drilling riser according to claim 1.

8. A system of vibration reduction control on the installation of a deepwater drilling riser, comprising: a remote operated vehicle connecting with a bottom assembly of the riser and a blowout preventer stack, the system further comprises the device of vibration reduction control on the installation of a deepwater drilling riser according to claim 7.

9. A computer-readable storage medium, wherein the computer-readable storage medium is stored with a computer execution instruction, and the computer execution instruction is configured to implement the method of vibration reduction control on the installation of a deepwater drilling riser according to claim 1 when the computer execution instruction is executed by a processor.

* * * * *